US012590553B2

(12) United States Patent
Schrattenberger et al.

(10) Patent No.: US 12,590,553 B2
(45) Date of Patent: Mar. 31, 2026

(54) INTERNAL COMBUSTION ENGINE FOR A MOTOR VEHICLE, MOTOR VEHICLE, AND METHOD

(71) Applicant: Bayerische Motoren Werke Aktiengesellschaft, Munich (DE)

(72) Inventors: Andreas Schrattenberger, Munich (DE); Frank Zimmermann, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 0 days.

(21) Appl. No.: 18/279,160

(22) PCT Filed: Mar. 8, 2022

(86) PCT No.: PCT/EP2022/055784

§ 371 (c)(1),
(2) Date: Aug. 28, 2023

(87) PCT Pub. No.: WO2022/207247

PCT Pub. Date: Oct. 6, 2022

(65) Prior Publication Data

US 2024/0125258 A1 Apr. 18, 2024

(30) Foreign Application Priority Data

Apr. 1, 2021 (DE) ..... 10 2021 108 393.1

(51) Int. Cl.
*F01M 13/04* (2006.01)
*F01M 11/06* (2006.01)
*F01M 13/00* (2006.01)

(52) U.S. Cl.
CPC ..... *F01M 13/04* (2013.01); *F01M 11/061* (2013.01); *F01M 2013/0061* (2013.01)

(58) Field of Classification Search
CPC ..... F01M 13/04; F01M 11/061; F01M 2013/0061; F01M 11/02; F01M 13/0416
See application file for complete search history.

(56) References Cited

U.S. PATENT DOCUMENTS

2016/0138442 A1 5/2016 An et al.
2016/0177791 A1* 6/2016 Kira ..... F01M 13/0416 123/573

(Continued)

FOREIGN PATENT DOCUMENTS

DE 4239108 A1 * 5/1994 ..... F01M 13/04
DE 20 2004 010 550 U1 11/2005

(Continued)

OTHER PUBLICATIONS

International Search Report (PCT/ISA/210) issued in PCT Application No. PCT/EP2022/055784 dated Jun. 23, 2022 with English translation (5 pages).

(Continued)

*Primary Examiner* — Syed O Hasan
(74) *Attorney, Agent, or Firm* — Crowell & Moring LLP

(57) ABSTRACT

An internal combustion engine for a motor vehicle includes a crankcase. The crankcase has having at least two oil separation devices and having a return device. The return device has at least one first return channel that is flowable through by a first portion of the oil separated from the blow-by gas with a first of the oil separation devices, through which the first portion of the separated oil is guided from the first oil separation device into the reservoir. The return device also has at least one second return channel that is at least partially spaced apart from the first return channel and is flowable through by a second portion of the oil separated from the blow-by gas via the second oil separation device, through which second return channel the second (Continued)

portion of the separated oil is guided from the second oil separation device into the reservoir.

7 Claims, 4 Drawing Sheets

(56) References Cited

U.S. PATENT DOCUMENTS

| | | | | |
|---|---|---|---|---|
| 2019/0055865 | A1* | 2/2019 | Nakamura | F01M 11/0004 |
| 2022/0403764 | A1* | 12/2022 | Takami | F01M 13/04 |

FOREIGN PATENT DOCUMENTS

| | | | | |
|---|---|---|---|---|
| DE | 10 2008 029 904 | A1 | 12/2009 | |
| EP | 2905438 | A1 * | 8/2015 | F01M 13/022 |
| EP | 3 034 820 | A2 | 6/2016 | |
| EP | 3 020 934 | B1 | 5/2019 | |
| JP | 5-58807 | U | 8/1993 | |
| WO | WO 2009/156036 | A1 | 12/2009 | |

OTHER PUBLICATIONS

German-language Written Opinion (PCT/ISA/237) issued in PCT Application No. PCT/EP2022/055784 dated Jun. 23, 2022 with English translation (8 pages).

German-language Search Report issued in German Application No. 10 2021 108 393.1 dated Jan. 14, 2022 with partial English translation (12 pages).

English translation of Chinese-language Office Action issued in Chinese Application No. 202280010854.0 dated Oct. 31, 2025 (8 pages).

* cited by examiner

INTERNAL COMBUSTION ENGINE FOR A MOTOR VEHICLE, MOTOR VEHICLE, AND METHOD

BACKGROUND

The disclosure relates to an internal combustion engine for a motor vehicle, to a motor vehicle, and to a method for operating an internal combustion engine of a motor vehicle.

EP 3 020 934 B1 discloses a vehicle with an internal combustion engine which comprises a crankcase and a charging device, having a crankcase ventilation device which comprises at least one inertia-based oil separator device with at least one inertia-based oil separator, an oil return returning separated oil to the crankcase, and an ejector which is driven by compressed air from the charging device, generating a vacuum to drive blow-by gas. The crankcase ventilation device comprises a pump control valve which regulates and/or controls the flow of compressed air through the ejector and which has a loss part which is arranged in a loaded manner against a valve seat force and which is lifted off the valve seat against the force when a threshold pressure difference between a valve inlet and a valve outlet is exceeded or a threshold pressure at the inlet end is exceeded, so that the pump control valve is opened.

Furthermore, a ventilation device for removing blow-by gas from an engine block of an internal combustion engine, having a first inlet opening and a second inlet opening spaced apart from the first inlet opening for admitting blow-by gas which originates from the engine block into the ventilation device, and having at least one oil separator for separating oil from the blow-by gas is disclosed in EP 3 034 820 A2. The ventilation device comprises a first supply channel for supplying blow-by gas to the at least one oil separator, wherein the first supply channel runs from the first inlet opening to an oil separator of this kind, and a second supply channel for supplying blow-by gas to the at least one oil separator, wherein the second supply channel runs from the second inlet opening to a connection point which is arranged upstream of the at least one oil separator in the first supply channel.

SUMMARY

The object of the disclosure is to create an internal combustion engine for a motor vehicle, a motor vehicle having an internal combustion engine of this kind, and a method for operating an internal combustion engine of this kind, such that oil can be particularly advantageously separated from a blow-by gas from the internal combustion engine.

This object is achieved according to the disclosure by an internal combustion engine for a motor vehicle having the features disclosed herein, by a motor vehicle having an internal combustion engine of this kind exhibiting the features disclosed herein, and by a method for operating an internal combustion engine of this kind of a motor vehicle of this kind exhibiting the features disclosed herein. Advantageous embodiments are the subject matter of the description.

A first aspect of the disclosure relates to an internal combustion engine for a motor vehicle which is preferably in the form of an automobile, in particular a passenger vehicle, commercial vehicle, or truck. The internal combustion engine has an output shaft, particularly in the form of a crankshaft, via which the motor vehicle can be driven. The internal combustion engine comprises a crankcase, particularly referred to as a cylinder crankcase, which at least partially delimits at least one cylinder and a crank chamber of the internal combustion engine. The output shaft is at least partially arranged within the crankcase and therefore in the crank chamber, wherein the output shaft is rotatable relative to the crankcase.

In the cylinder, a piston is preferably movably arranged in a translational manner relative to a cylinder wall of the cylinder. The cylinder wall may be formed by the crankcase. The cylinder wall and the piston partially delimit a combustion chamber of the internal combustion engine. The internal combustion engine has an intake tract through which air can flow and an exhaust tract through which exhaust gas from the internal combustion engine can flow. Air can be supplied to the combustion chamber via the intake tract, and exhaust gas can be discharged from the combustion chamber via the exhaust tract. The air flowing through the intake tract may, in particular, be referred to as fresh air. At least one compressor can be arranged in the intake tract, by means of which the air flowing through the intake tract can be compressed and conveyed into the combustion chamber. The internal combustion engine preferably has a cylinder head which partially delimits the combustion chamber. An intake channel through which air can flow, and which is part of the intake tract, may run within the cylinder head, wherein the air flowing through the intake channel can be fed to the combustion chamber. In other words, the intake tract may run at least in part within the cylinder head, so that the air flowing through the intake tract can be fed through the cylinder head via the intake channel. When the internal combustion engine is in an activated state, combustion processes take place in the combustion chamber, during which a fuel-air mixture comprising the fresh air is combusted, resulting in the exhaust gas from the internal combustion engine. The combustion processes may, in particular, be referred to as combustion.

The internal combustion engine has at least two oil separation devices, in particular designed to be separate from one another, by means of which oil can be separated from blow-by gas discharged from the crankcase, in particular the crank chamber, and fed to the oil separation devices. The oil separation devices may be referred to, in particular, as oil separators or as oil mist separators. Blow-by gas may, in particular, be understood to mean exhaust gas which enters or flows into the crankcase, in particular the crankcase chamber, from the combustion chamber, in particular through a gap formed at least partially by the piston, or at least one piston ring arranged on the piston, and the cylinder wall. The blow-by gas may include oil, wherein the oil can be removed from the blow-by gas, for example, when the blow-by gas flows from the combustion chamber to the crankcase chamber. In this case, the oil, which can wet the cylinder wall and/or the piston rings, can be entrained by the blow-by gas as it flows through the gap, thereby allowing the oil to be taken up by the blow-by gas. In addition, the oil may be provided for lubrication, for example, in particular for a bearing of the output shaft, in the crankcase or the crankcase chamber, and it can be taken up by the blow-by gas in the crankcase chamber during this. Particularly because the blow-by gas may include oil, the blow-by gas can, in particular, be referred to as oil mist. The discharge of the blow-by gas from the crankcase chamber or the separation of the oil from the blow-by gas may, in particular, be referred to as crankcase ventilation. For example, the blow-by gas can be discharged from the crankcase chamber and fed to the oil separation devices via a conduit element.

One of the oil separation devices is preferably designed as a full-load oil separator and the other of the oil separation devices is preferably designed as a part-load oil separator. This may, in particular, be taken to mean that in an operating state of the internal combustion engine referred to as full load, the oil can be separated, or is separated, from the blow-by gas by means of the full-load oil separator, wherein separation of the oil from the blow-by gas by the part-load oil separator preferably does not occur. In an operating state of the internal combustion engine referred to as part load, which is different from full load, the oil can be separated, or is separated, from the blow-by gas by means of the part-load oil separator, wherein the separation of oil from the blow-by gas by means of the full-load oil separator preferably does not occur. In the operating state referred to as full-load, a torque of the internal combustion engine or of the output shaft may be particularly high, for example, and may correspond to a maximum torque of the internal combustion engine, for example. In the operating state referred to as part-load, the torque of the internal combustion engine or of the output shaft may be particularly low, in particular lower than in the case of full load, and it may, for example, be less than 50 percent of the maximum torque of the internal combustion engine.

When the oil is separated from the blow-by gas by means of the oil separation devices, the blow-by gas flows through the respective oil separation device, as a result of which the oil is separated from the blow-by gas by means of the respective oil separation device, and the blow-by gas is therefore cleaned of oil by means of the respective oil separation device and is therefore preferably free of oil following separation. The blow-by gas freed of oil by means of the oil separation devices during the oil separation can be fed to the intake tract following separation and therefore introduced into the intake tract. In full load, the blow-by gas is preferably introduced into the intake tract upstream of the compressor in the direction of flow of the air flowing through the intake tract after the oil has been separated by means of the full-load oil separator. In part load, the blow-by gas is preferably introduced into the intake tract downstream of the compressor in the direction of flow of the air flowing through the intake tract, in particular into the inlet channel, after the oil has been separated by means of the part-load oil separator.

The internal combustion engine comprises return devices through which the oil separated by means of the oil separation devices can flow, through which the oil separated from the blow-by gas by means of the oil separation devices can be guided or introduced into a reservoir. The reservoir is preferably designed as an oil pan which is provided for collecting the oil. The oil pan may, in particular be referred to as an oil sump. The reservoir is preferably arranged in the vertical direction of the vehicle below the oil separation devices in the installed position of the internal combustion engine, wherein the internal combustion engine assumes the installation position in the vehicle in its fully manufactured state. The internal combustion engine assumes the installation position in a fully manufactured state of the vehicle. The reservoir can be arranged, for example, in the installed position of the internal combustion engine in the vertical direction of the vehicle below the crankcase or in the crankcase or the crankcase chamber.

So that the oil can be separated from the blow-by gas particularly advantageously, the return device has at least one first return channel that can be flowed through by a first portion of the oil separated from the blow-by gas by means of a first of the oil separation devices, through which the first portion of the separated oil can be introduced from the first oil separation device into the reservoir, and at least one second return channel that is at least partially spaced apart from the first return channel and can be flowed through by a second portion of the oil separated from the blow-by gas by means of a second of the oil separation devices, through which second return channel the second portion of the separated oil can be guided from the second oil separation device into the reservoir. In other words, the return device comprises return channels which are at least partially separated, in particular designed to be separate from one another, wherein the first oil separation device is fluidically connected to the reservoir via the first return channel, and the second oil separation device is fluidically connected to the reservoir via the second return channel, whereby the first portion of the oil can be introduced into the reservoir via the first return channel, and the second portion of the oil can be introduced into the reservoir via the second return channel. The return channel assigned to the full-load oil separator may, in particular, be referred to as the full-load separation channel, and the return channel assigned to the part-load oil separator may, in particular, be referred to as the part-load separation channel.

The disclosure is based, in particular, on the following knowhow and considerations: The filtration efficiency of the respective oil separation device can depend, particularly directly, on a pressure loss, referred to in particular as pressure loss potential, considered in the flow direction of the oil across the oil separation device. The pressure loss can, in particular, be understood to be a pressure difference, in particular a hydrostatic pressure difference, between two pressures, wherein a first of the pressures can be a pressure of the oil in the oil separation device, and the second of the pressures can be a pressure of the oil in the return device or in the reservoir. Filtration efficiency can be understood to mean, in particular, an efficiency of the oil separated by means of the respective oil separation device, in particular a degree of separation. Typically, a particularly high filtration efficiency can be achieved with a particularly high pressure loss. Furthermore, a particularly high robustness in relation to oil entrainment can be achieved by means of the particularly high pressure loss. Oil entrainment can, in particular, be understood to mean oil passing through the return device, in particular referred to as an oil return channel, upwards in the vertical direction of the vehicle, contrary to the originally intended flow direction of the oil flowing through the return device, into the respective oil separation device, in particular into a separation chamber of the respective oil separation device and/or even into the intake tract, in particular in the direction of flow of the air flowing through the intake tract upstream of the compressor and/or into the inlet channel. If the oil can enter the oil separation device upwards in the vertical direction of the vehicle, for example, the filtration efficiency of the oil separator can decrease particularly sharply. Particularly when the oil can enter the intake tract, the oil can enter the combustion chamber via the intake tract where it can participate in the combustion processes, as a result of which emissions of noxious substances from the internal combustion engine can be particularly increased.

In a conventional internal combustion engine, the return device may only have exactly one return channel through which the first portion and the second portion of the separated oil from each oil separation device can be guided into the reservoir. In other words, in a conventional internal combustion engine, the two oil separation devices can have a shared return channel. In this case, space restrictions in particular mean that one of the oil separation devices can be arranged below the other oil separation devices in the vertical direction of the vehicle, for example the part-load oil separator may be arranged below the full-load oil separator in the vertical direction of the vehicle. As a result, there can be a particularly small geodetic height difference, referred to in particular as the geodetic height, between the respective oil separation device, in particular the lower oil separation devices in the vertical direction of the vehicle, and the reservoir. The geodetic height difference in this case can be understood to mean a distance between two points running in the vertical direction of the vehicle, wherein a first of the points can be arranged in a respective outlet opening of the respective oil separation device, for example, and the second point can be arranged in the reservoir. The oil separation device in each case is fluidically connected to the return device via the respective outlet opening. The first point in this case is preferably a lowest point of the outlet opening in the vertical direction of the vehicle. For example, the second point is a highest point of the reservoir in the vertical direction of the vehicle. Due to the particularly small geodetic height difference, the pressure loss potential, and therefore the filtration efficiency of the respective oil separation device, can be particularly low in a conventional internal combustion engine. As a consequence of the particularly small geodetic height difference and also due to the installation position of the internal combustion engine in the vehicle, and possibly due to particularly fast cornering of the vehicle, the geodetic height difference of the vehicle may no longer be sufficient, so that the oil can be forced through the return device, contrary to the originally intended flow direction of the oil, upward in the vertical direction of the vehicle into the oil separation devices, in particular into the separation chambers, or even into the intake tract.

In contrast, in the internal combustion engine according to the disclosure, particularly on account of the two return channels being spaced apart from one another, the geodetic height difference or the distance is particularly high. This means that the oil can be cleanly guided downwards in the vertical direction of the vehicle into the reservoir in all driving states of the vehicle, in particular during cornering, even under particularly high lateral acceleration, and it is prevented from reaching the oil separation devices upwards in the vertical direction of the vehicle. Due to the geodetic height difference, the pressure loss potential can be particularly increased, as a result of which the filtration efficiency of the respective oil separation devices can be particularly increased. In other words, the oil separation devices can be arranged particularly high in the vertical direction of the vehicle in the internal combustion engine, and can thereby be displaced particularly far upwards compared with a conventional internal combustion engine, as a result of which the geodetic height difference or distance can be particularly increased.

In another embodiment of the disclosure, the internal combustion engine comprises the reservoir, and the oil separation devices are each spaced apart from the reservoir at the same distance in the installed position of the internal combustion engine in the vertical direction of the vehicle. This can be taken to mean, in particular, that the first point of each oil separation device in each case is spaced apart from the second point at the same distance in the vertical direction of the vehicle. As a result, both oil separation devices have the same geodetic height difference or the same geodetic height difference value, which means that the pressure loss potential for both oil separation devices can be particularly increased. Due to the fact that the internal combustion engine according to the disclosure comprises the reservoir in the embodiment, the reservoir in the embodiment falls within the scope of protection of the internal combustion engine according to the disclosure.

In another embodiment of the disclosure, the return channels have at least one length section through which the oil can flow and which runs within a housing wall of the crankcase, which length section is delimited at least partially, in particular completely circumferentially, in its circumferential direction by the housing wall, in particular directly. In other words, the two portions of oil are guided through the housing wall of the crankcase via the length section of the return channels in each case. Again, to put it another way, the oil discharged from the respective oil separation device can be taken up by the respective return channel, in particular at an interface with the cylinder head, and thereby guided downwards through the crankcase in the vertical direction of the vehicle to the reservoir. This allows the oil separated from the blow-by gas by means of the oil separation devices to be guided particularly advantageously into the reservoir by the oil separation devices, which means that manufacturing costs or manufacturing expenditure on the internal combustion engine and/or the installation space of the internal combustion engine, for example, can be kept particularly low.

In a further embodiment, the internal combustion engine comprises opening points in each case, at which the return channels open into at least one receiving area bounded, in particular directly, by the reservoir, in which the oil can be received. In other words, the oil flowing through the respective return channel can be discharged from, or directed out of, the respective return channel via the respective opening point and introduced into the reservoir, wherein the respective return channel is fluidically connected to the receiving area by means of the respective opening point. This means that the oil flowing through the return channels can be introduced particularly advantageously into the reservoir.

In a further embodiment, when the internal combustion engine is in the installed position, at least one of the opening points is arranged below an oil level, particularly referred to as the desired oil level, of the oil located in the reservoir. In other words, particularly when the vehicle is non-operational and/or the vehicle is on a level road surface and/or the internal combustion engine is in a deactivated state and/or when the oil received in the receiving area or the reservoir has a temperature of 25° Celsius and/or the internal combustion engine includes a defined oil quantity, in particularly referred to as the target oil quantity, which is provided for normal operation of the internal combustion engine in its fully manufactured state, at least one of the opening points is arranged below the oil level, particularly referred to as the target oil level, in the vertical direction of the vehicle. The vehicle being non-operational can be particularly understood to mean that the vehicle is stationary and is not therefore moving relative to the road surface. The road surface being level can be particularly understood to mean that the road surface is not inclined, in other words it does not have a gradient. The deactivated state of the internal combustion engine refers to an operating state of the internal combustion engine that differs from the activated state, wherein in the deactivated state the combustion processes do not occur in the combustion chamber.

In a conventional internal combustion engine, an oil siphon through which the oil can flow may be arranged in the flow direction of the oil flowing from the respective oil separation device to the reservoir, for example in the cylinder head. The oil siphon has at least one curved section, for example, in which the oil can collect, wherein the oil collected in the section can flow out of the section, particularly when the fill level of the section is exceeded, and thereby be discharged from the oil siphon, for example, and introduced into the return device. The oil siphon in the conventional internal combustion engine may, in particular, be arranged directly on the oil separation device and referred to as a bird bath. The oil siphon may perform a function particularly referred to as a tightness function, since the oil siphon may be gas-impermeable due to the oil located there. A second geodetic height difference or a second distance between the oil siphon and the respective oil separation device in the vertical direction of the vehicle can be particularly small in the conventional internal combustion engine, meaning that the pressure loss potential, and therefore the filtration efficiency of the respective oil separation device, can be particularly low. Due to the fact that in the internal combustion engine according to the disclosure, at least one of the opening points is arranged below the oil level of the oil located in the oil pan in the vertical direction of the vehicle when the internal combustion engine is in the installed position, the oil siphon can be dispensed with in the conventional internal combustion engine, since the reservoir, in particular the oil pan, can assume the function of the conventional oil siphon. In other words, a position of the oil siphon in the vertical direction of the vehicle, particularly compared with the conventional internal combustion engine, can be moved particularly far downwards, as a result of which the second distance, or the second geodetic height difference, can be particularly increased. The geodetic height difference may correspond to the second geodetic height difference in this case. This means that the filtration efficiency or the pressure loss potential, for example, can be particularly increased.

For example, the respective return channel may run at least partially within a reservoir wall, which delimits the reservoir at least partially, and be guided in the vertical direction of the vehicle in this case, below the desired oil level of the reservoir. This enables the respective return channel or the oil flowing through the respective return channel in the vertical direction of the vehicle below the desired oil level to communicate with an interior of the reservoir particularly referred to as the pan interior. Alternatively, at least one of the opening points may be arranged above the oil level of the oil located in the oil pan when the internal combustion engine is in the installed position in the vertical direction of the vehicle.

In another embodiment, the oil separation devices are arranged in a cylinder head cover which is arranged above the cylinder head of the internal combustion engine in the vertical direction of the vehicle when the internal combustion engine is in the installed position. In other words, the oil separation devices are at least partially surrounded by the cylinder head cover. The cylinder head is arranged above the crankcase in the vertical direction of the vehicle and delimits the crankcase upwards in the vertical direction of the vehicle at least partially, in particular directly. The cylinder head cover may, in particular, be referred to as a valve cover and delimit the cylinder head upwards in the vertical direction of the vehicle at least partially, in particular directly. Due to the fact that the oil separation devices are arranged in the cylinder head cover, the geodetic height difference or the distance can be particularly increased, thereby particularly increasing the pressure loss potential.

In a further embodiment, the return channels each have at least one second length section, through which the oil can flow and which is arranged upstream of the respective length section in the flow direction of the oil flowing through the return channels, which second length section runs within the cylinder head, wherein the second length section is delimited at least partially, in particular completely circumferentially, in its circumferential direction by the cylinder head, in particular directly. In other words, at least the second length section of the return channels in each case is arranged in the cylinder head, allowing the two portions of oil from the respective oil separation device to be guided or conducted through the cylinder head into the reservoir. This enables the two portions of oil from the respective oil separation devices to be guided from the cylinder head cover via the cylinder head through the crankcase and into the reservoir.

In another embodiment, the respective return channel is produced by means of drilling and/or by means of casting. In other words, the respective length section and/or the respective second length section are produced by means of drilling, and thereby realized as a bore, and/or are produced by means of casting and are therefore cast. Again, in other words, the respective return channel can be mechanically processed by means of drilling and/or the respective return channel can be cast. Production of the respective return channel configured as a bore can be carried out by means of two intersecting bores, for example, wherein a first of the bores can be made starting from the cylinder head, which can be particularly referred to as the bore coming from a top surface, and a second bore can be made starting from the reservoir side, which can be particularly referred to as the bore coming from the reservoir side or the oil pan side. The casting of the respective return channels is preferably carried out by means of at least one core. The respective return channel can be produced particularly cost-effectively and/or with particular precision by drilling or casting. The cross-sections of the return channels in each case can be made to different sizes in accordance with requirements and manufacturing possibilities. At least one sealing element can be installed between the reservoir and the crankcase, in particular the housing wall. In other words, the sealing element can be arranged between the reservoir and the crankcase, in particular the housing wall, by means of which a particularly tight seal can be provided for the reservoir or the return channel in each case.

A second aspect of the disclosure relates to a motor vehicle which has an internal combustion engine according to the disclosure in accordance with the first aspect of the disclosure. Advantages and advantageous embodiments of the first aspect of the disclosure are to be regarded as advantages and advantageous embodiments of the second aspect of the disclosure, and vice versa. The motor vehicle according to the disclosure is preferably in the form of an automobile, in particular a passenger car, utility vehicle, or truck, or a bus or motorcycle.

A third aspect of the disclosure relates to a method for operating an internal combustion engine for a motor vehicle in accordance with the first aspect of the disclosure, which includes a crankcase and at least two oil separation devices designed separately from one another. Advantages and advantageous embodiments of the first and second aspects of the disclosure are to be regarded as advantages and advantageous embodiments of the third aspect of the disclosure, and vice versa.

With the method according to the disclosure, oil is separated from blow-by gas discharged from the crankcase and fed to the oil separation devices by means of the oil separation devices and by means of a return device through which the oil separated by means of the oil separation devices can flow, the oil separated from the blow-by gas by means of the oil separation devices is guided or introduced from the oil separation devices into a reservoir. The reservoir is preferably arranged in the vertical direction of the vehicle below the oil separation devices in the installed position of the internal combustion engine. The reservoir is preferably designed as an oil pan in which oil introduced into the oil pan is collected.

So that the oil can be particularly advantageously separated from the blow-by gas, it is provided according to the disclosure that the return device has at least one first return channel that can be traversed by a first portion of the oil separated from the blow-by gas by means of a first of the oil separation devices, through which the first portion of the separated oil can be guided from the first oil separation device into the reservoir, and at least one second return channel that is at least partially spaced apart from the first return channel and can be traversed by a second portion of the oil separated from the blow-by gas by means of the second oil separation devices, through which the second portion of the separated oil is guided from the second oil separation device into the reservoir.

Further features of the disclosure arise from the claims, the figures, and the figure description. The features and combinations of features referred to above in the description and the features and combinations of features referred to below in the figure description and/or shown solely in the figures can be used not only in the combination specified, but also in other combinations or individually.

The disclosure will now be explained in greater detail using a preferred embodiment and making reference to the drawings. In the drawings:

DETAILED DESCRIPTION

In the figures, identical or functionally identical elements are provided with the same reference signs.

Figure 1:
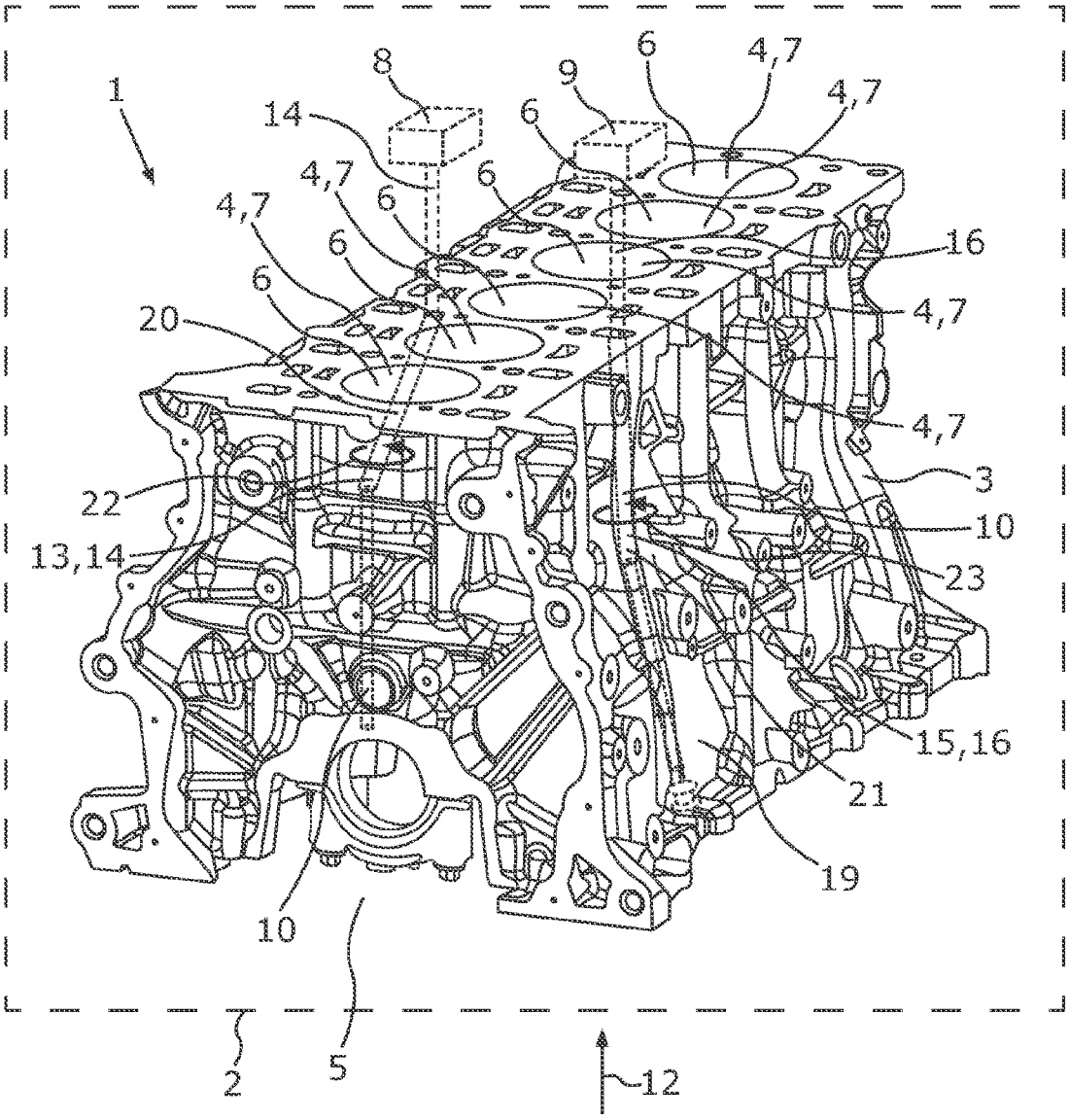
FIG. 1 shows a schematic partial sectional view of an internal combustion engine in a perspective view.
Figure 2:
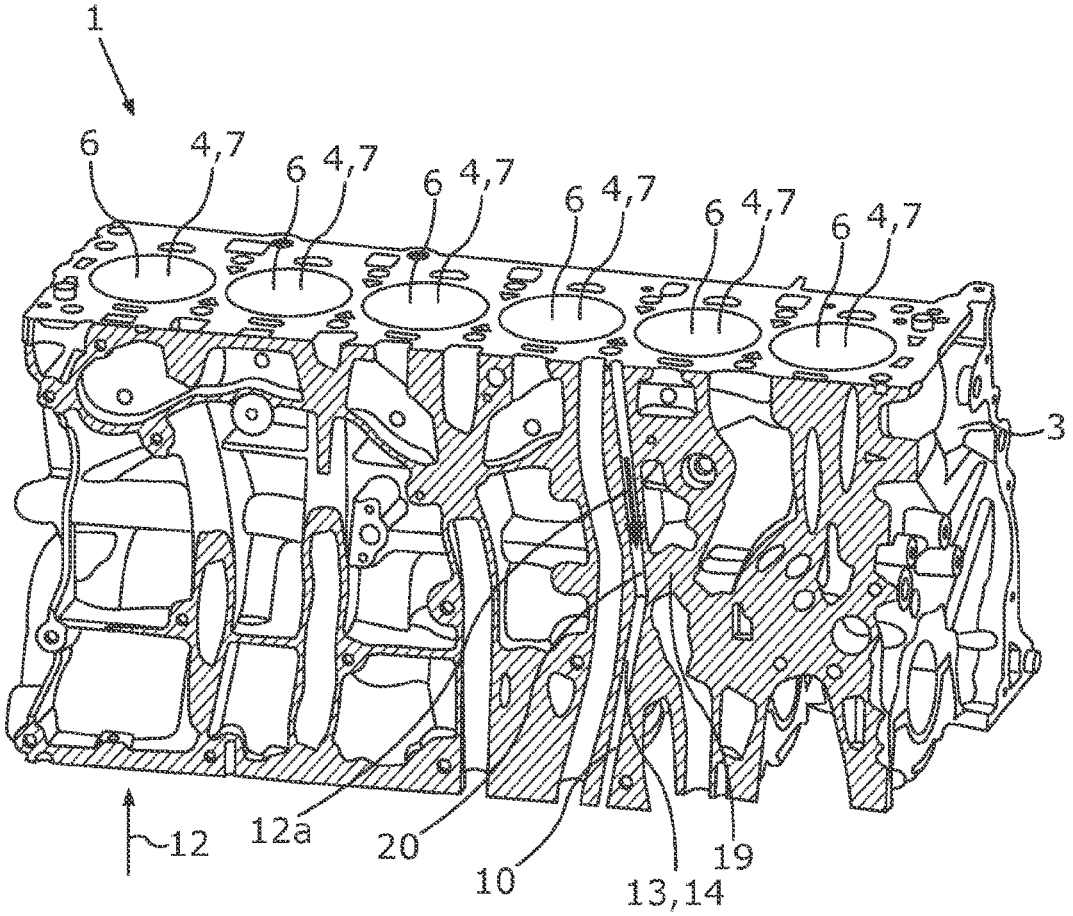
FIG. 2 shows a schematic partial sectional view of an internal combustion engine in a side perspective view.
Figure 3:
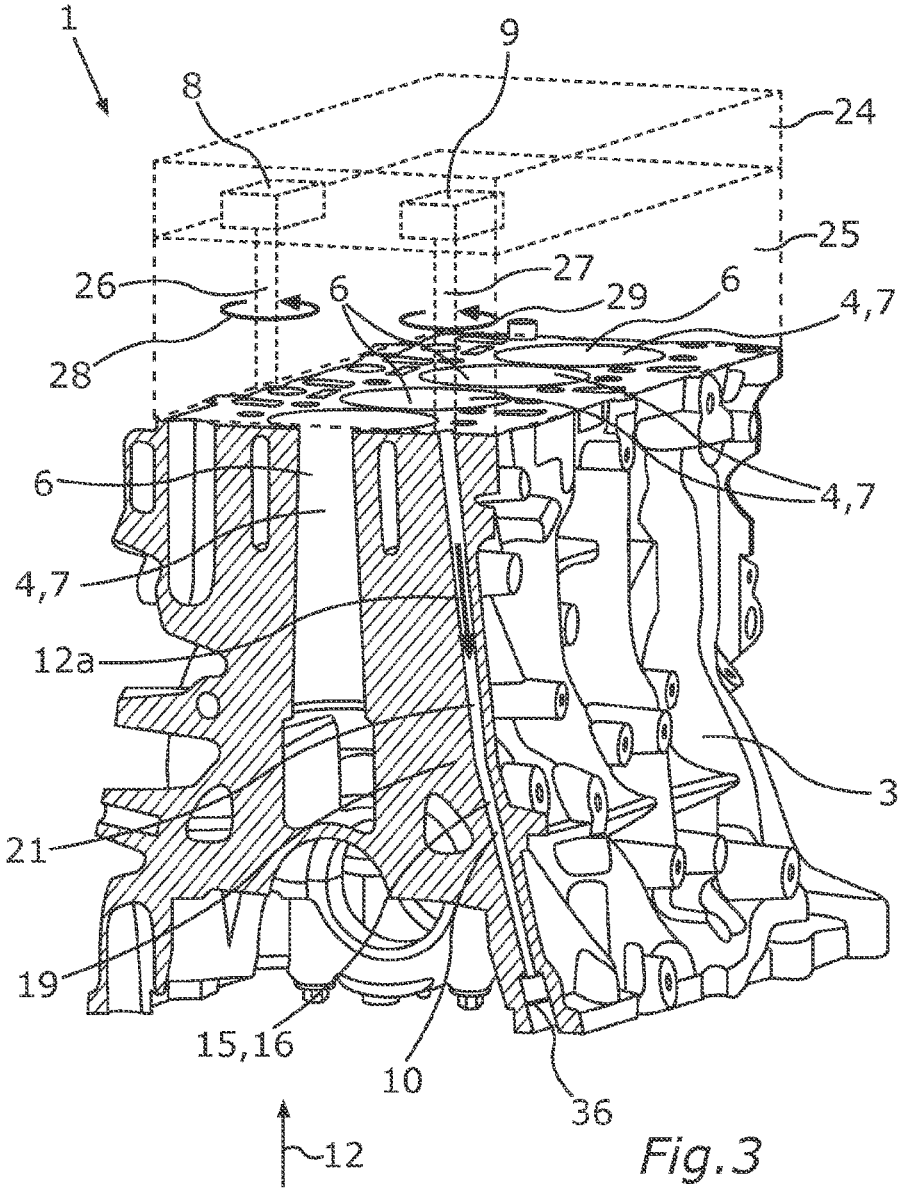
FIG. 3 shows a schematic partial sectional view of an internal combustion engine in a front perspective view.

FIG. 1 shows a schematic partial sectional view of an internal combustion engine 1 for a motor vehicle 2 in a perspective view, and FIG. 2 shows a schematic partial sectional view of the internal combustion engine 1 in a side perspective view, and FIG. 3 shows a schematic partial sectional view of the internal combustion engine 1 in a front perspective view. The motor vehicle 2 is preferably in the form of an automobile, in particular a passenger vehicle, commercial vehicle, or truck. The internal combustion engine 1 comprises an output shaft, in particular designed as a crankshaft, via which the motor vehicle 2 can be driven by the internal combustion engine 1.

The internal combustion engine 1 has at least one crankcase 3, particularly referred to as a cylinder crankcase, which at least partially delimits at least one cylinder 4 and a crankcase chamber 5 of the internal combustion engine 1, wherein the internal combustion engine 1 shown in the exemplary embodiment comprises six cylinders 4. The respective cylinder 4 has a cylinder wall 6 in each case, which partially delimits a combustion chamber 7 in each case. A piston is arranged in each cylinder 4 and is translationally movable relative to the cylinder wall 6. The internal combustion engine 1 has an intake tract through which air can flow and an exhaust tract through which the exhaust gas from the combustion chamber 7 can flow. The air, particularly referred to as fresh air, can be supplied to the combustion chamber 7 via the intake tract, and the exhaust gas from the combustion chamber 7 can be discharged via the exhaust tract. When the internal combustion engine is in an activated state, combustion processes, particularly referred to as combustion, take place in the respective combustion chamber 7, wherein a fuel-air mixture comprising fresh air is combusted, resulting in the exhaust gas from the internal combustion engine 1.

Figure 4:
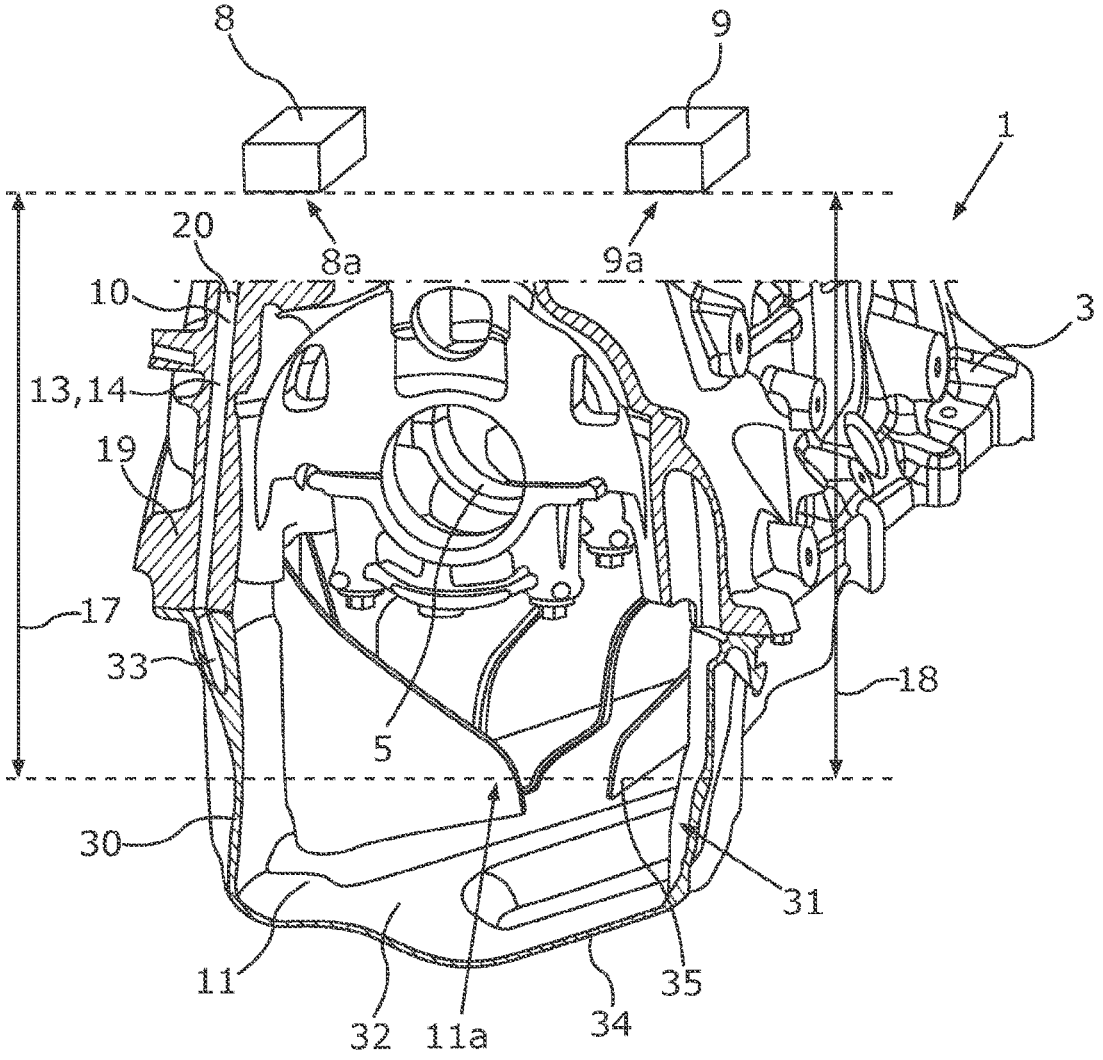
FIG. 4 shows a schematic partial sectional view of an internal combustion engine in a front perspective view.

Particularly when the internal combustion engine 1 is in the activated state, a gas, in particular exhaust gas, can enter the crankcase 3 or crankcase chamber 5 from the respective combustion chamber 7, particularly through a gap formed at least partially by the respective piston and the respective cylinder wall 6, wherein the gas that enters the crankcase 3 or crankcase 5 from the respective combustion chamber 7 and is located in the crankcase chamber 5 can be referred to as blow-by gas. The internal combustion engine 1 has at least two oil separation devices 8, 9, which are particularly designed to be separate from one another, by means of which oil can be separated from the blow-by gas discharged from the crankcase 3 or crankcase chamber 5 and fed to the oil separation devices 8, 9. The oil separation devices 8, 9 are schematically depicted in FIGS. 1 and 3. The internal combustion engine 1 comprises a return device 10 through which the oil separated by means of the oil separation devices 8, 9 can flow, via which oil separation device the oil separated from the blow-by gas by means of the oil separation devices 8, 9 can be guided or introduced from the oil separation devices 8, 9 into a reservoir 11. The reservoir 11 may, in particular, be designed as an oil pan, provided for collecting the oil. The reservoir 11 is preferably arranged with the internal combustion engine in the installed position in the vertical direction of the vehicle 12 below the oil separation devices 8, 9 in the crankcase 3 or the crankcase chamber 5 or below the crankcase 3 in the vertical direction of the vehicle 12. In its fully manufactured state, the internal combustion engine 1 assumes the installed position in the motor vehicle 2 in a fully manufactured state of the vehicle 2. The reservoir 11 is shown in FIG. 4, which depicts a schematic partial sectional view of the internal combustion engine 1 in a front perspective view. In a designated flow direction 12*a*, the oil flowing through the return device 10 flows from the respective oil separation device 8, 9 to the reservoir 11.

So that the oil can be separated from the blow-by gas particularly advantageously, the return device 10 has at least one first return channel 14 that can be flowed through by a first portion 13 of the oil separated from the blow-by gas by means of a first of the oil separation devices 8, through which the first portion 13 of the separated oil can be guided from the first oil separation device 8 into the reservoir 11, and at least one second return channel 16 that is at least partially spaced apart from the first return channel 14 and can be flowed through by a second portion 15 of the oil separated from the blow-by gas by means of a second of the oil separation devices 9, through which the second portion 15 of the separated oil can be guided from the second oil separation device 9 into the reservoir 11.

As a result, a respective geodetic height difference or a respective distance 17, 18 in the vertical direction of the vehicle 12 between the respective oil separation device 8, 9 and the reservoir 11 can be particularly increased. The respective distance 17, 18 runs in the vertical direction of the vehicle 12, for example, between a respective first point 8*a*, 9*a* of the respective oil separation device 8, 9 and a second point 11*a* of the reservoir 11. The respective first point 8*a*, 9*a* is arranged, for example, in a respective outlet opening of the respective oil separation device 8, 9, for example, and the second point 11*a* is arranged in the reservoir 11. The respective oil separation device 8, 9 is fluidically connected to the return device 10 via the respective outlet opening. The respective first point 8*a*, 9*a* in this case is preferably a lowest point of the respective outlet opening in the vertical direction of the vehicle 12. The fact that the respective distance 17, 18 can be particularly increased means that a respective pressure loss potential of the respective oil separation device 8, 9 can be particularly increased. This means, on the one hand, that a filtration efficiency of the respective oil separation device 8, 9 can be particularly increased and, on the other hand, it is possible to prevent oil located in the reservoir 11 from flowing upwards through the return device 10, in particular the respective return channel 14, 16, in the vertical direction of the vehicle 12 and therefore against the intended flow direction 12*a* to the respective oil separation device 8, 9. In this way, the filtration efficiency of the respective oil separation device 8, 9 can be particularly increased and an introduction of returned oil into the intake tract can be avoided, as a result of which noxious emissions from the internal combustion engine 1 can be kept particularly low.

In the installed position of the internal combustion engine 1 in the motor vehicle 2, the oil separation devices 8, 9 are preferably spaced at equal distances from the reservoir 11 in the vertical direction of the vehicle 12. In other words, a first of the distances 17 between the first oil separation device 8 and the reservoir 11 is the same as the second of the distances 18 between the second oil separation device 9 and the reservoir 11. In this way, both geodetic height differences or both distances 17, 18 can be particularly increased, enabling both oil separation devices 8, 9 to have a particularly high pressure loss potential.

In a further embodiment, the return channels 14, 16 each have at least one length section 20, 21 through which the oil can flow and which runs within a housing wall 19 of the crankcase 3, which length section 20, 21 is delimited at least partially, in particular completely circumferentially, in its respective circumferential direction 22, 23 by the housing wall 19, in particular directly. The first return channel 14, or the length section 20, 21 of the first return channel 14, is arranged on the inlet side in the crankcase 3. The second return channel 16, or the length section 20, 21 of the second return channel 16, is arranged on the inlet side in the crankcase 3. Arrangement on the inlet side or on the outlet side can, in particular, be understood to mean the following: With respect to an imaginary center plane of the cylinders 4 extending in the vertical direction of the vehicle 12 and in the longitudinal direction of the output shaft, a first side of the center plane can be referred to as the inlet side, wherein the air flowing through the intake tract is guided to the combustion chambers 7 via the first side and a second side of the center plane lying opposite the first side can be referred to as the outlet side, wherein the exhaust gas flowing through the exhaust tract is discharged from the combustion chambers 7 via the second side. The partial sectional view shown in FIG. 2 is a partial sectional view on the inlet side.

The first oil separation device 8 is preferably designed as a part-load oil separator, and the second oil separation device 9 is designed as a full-load oil separator. This means that the first return channel 14 is referred to as a part-load separation channel, and the second return channel 16 is referred to as a full-load separation channel.

The internal combustion engine 1 comprises a cylinder head 25, which is arranged above the crankcase 3 when the internal combustion engine 1 is in the installed position in the motor vehicle 2. The oil separation devices 8, 9 are preferably arranged in a cylinder head cover 24 which is arranged above the cylinder head 25 of the internal combustion engine 1 in the vertical direction of the vehicle 12 when the internal combustion engine 1 is in the installed position in the motor vehicle 2. The cylinder head cover 24 may, in particular, be referred to as a valve cover and delimit the cylinder head 25 upwards in the vertical direction of the vehicle 12 at least partially, in particular directly. Furthermore, the return channels 14, 16 each have at least one second length section 26, 27 through which the oil can flow and which is arranged upstream of the respective length section 20, 21 in the flow direction 12*a* of the oil flowing through the return channels 14, 16, which second length section 26, 27 runs within the cylinder head 25, wherein the second length section 26, 27 in each case is delimited at least partially, in particular completely circumferentially, in its respective circumferential direction 28, 29 by the cylinder head 25, in particular directly. This allows the oil to be guided from the respective oil separation device 8, 9 through the cylinder head 25 and the crankcase 3 into the reservoir 11, wherein, in particular, the fact that the oil separation devices 8, 9 are arranged in the cylinder head cover 24 means that the distances 17, 18 can be particularly increased.

In a further embodiment, the internal combustion engine 1 comprises opening points 30, 31 in each case, at which the return channels 14, 16 open into at least one receiving area 32 directly bounded by the reservoir 11, in which the oil can be received. This allows the oil flowing through the return channels 14, 16 to be discharged from, or directed out of, the respective return channel 14, 16 via the respective opening points 30, 31 and introduced into the reservoir 11 or the receiving area 32. The opening points 30, 31 are schematically depicted by way of example in FIG. 4. The return channels 14, 16 preferably each have at least one third length section 33, through which the oil can flow and which is arranged downstream of the respective length section 20, 21 in the flow direction 12*a* of the oil flowing through the return channels 14, 16, which third length section 33 runs within a reservoir wall 34 of the reservoir 11, wherein the third length section 33 is at least partially, in particular completely, delimited by the reservoir wall 34, in particular directly, in its circumferential direction.

In a further embodiment, when the internal combustion engine 1 is in the installed position in the motor vehicle 2, at least one of the opening points 30, 31 is arranged below an oil level 35, particularly referred to as the desired oil level, of the oil located in the reservoir 11. This allows the reservoir 11 to function as a siphon, particularly referred to as an oil siphon, eliminating the need for a corresponding oil siphon designed to be separate from the reservoir 11, wherein the oil collected in the reservoir 11 can flow out of the reservoir 11, for example when a defined fill level of the reservoir 11 is exceeded, particularly downwards to the side or and downwards to the side in the vertical direction of the vehicle. In other words, the oil siphon can be placed into the reservoir 11. Again, in other words, the third length section 33 can lengthen the respective return channel 14, 16 in the vertical direction of the vehicle 12 to below the oil level 35. Alternatively, at least one of the opening points 30, 31 may be arranged above the oil level 35 when the internal combustion engine 1 is in the installed position in the vertical direction of the vehicle 12.

The respective return channel 14, 16, in particular at least one of the respective length sections 20, 21, 26, 27, 33, is preferably produced by means of drilling and/or by means of casting. This allows the internal combustion engine 1, in particular the respective return channel 14, 16, to be produced particularly advantageously and particularly cost-effectively. In at least one of the respective return channels 14, 16, particularly in the respective length section 20, 21, there may be arranged at least one valve device 36, particularly referred to as a check valve, by means of which a respective mass flow of the oil flowing through the respective return channel 14, 16 can be adjusted. In this way, for example, a return flow of oil running from the reservoir 11 through the respective return channel 14, 16 to the respective oil separation device 8, 9, which would run against the flow direction 12*a*, can be particularly advantageously avoided.

LIST OF REFERENCE SIGNS

1 internal combustion engine
2 motor vehicle
3 crankcase
4 cylinder
5 crankcase chamber
6 cylinder wall
7 combustion chamber
8 first oil separation device
8*a* first point
9 second oil separation device
9*a* first point
10 return device
11 reservoir
11*a* second point
12 vertical direction of the vehicle
12*a* flow direction
13 first portion
14 first return channel
15 second portion
16 second return channel
17 first distance
18 second distance
19 housing wall
20 length section
21 length section
22 circumferential direction
23 circumferential direction
24 cylinder head cover
25 cylinder head
26 second length section
27 second length section
28 circumferential direction
29 circumferential direction
30 first opening point
31 second opening point
32 receiving area
33 third length section
34 reservoir wall
35 oil level
36 valve device

The invention claimed is:

1. An internal combustion engine for a motor vehicle, comprising:

a crankcase, having at least two oil separation devices, via which oil is separable from blow-by gas discharged from the crankcase and is fed to the oil separation devices, and having a return device, through which the oil separated via the oil separation devices flows, via which oil separation device the oil separated from the blow-by gas via the oil separation devices is guided from the oil separation devices into a reservoir disposed in a lowermost region of the crankcase, wherein the return device has at least one first return channel that is flowable through by a first portion of the oil separated from the blow-by gas with a first of the oil separation devices, through which the first portion of the separated oil is guided from the first oil separation device into the reservoir, and at least one second return channel that is at least partially spaced apart from the first return channel and is flowable through by a second portion of the oil separated from the blow-by gas via the second oil separation device, through which second return channel of the second portion of the separated oil is guided from the second oil separation device into the reservoir, the return channels each have at least one first length region through which the oil can flow, which runs within a housing wall of the crankcase and which is delimited in its circumferential direction at least partially by the housing wall, and wherein respective opening points are provided at which the return channels open into a receiving region which is delimited by the reservoir and in which the oil can be received, and the at least one of the opening points is arranged below an oil level of the oil located in the reservoir in the vertical direction of the vehicle, and the return channels each have at least one third length region arranged downstream of the first length section and through which the oil is flowable and which is arranged downstream of the respective length region in the flow direction of the oil flowing through the return channels, and which runs within a reservoir wall of the reservoir and which is delimited in its circumferential direction at least partially by the reservoir wall.

2. The internal combustion engine according to claim 1, wherein the oil separation devices are each spaced apart from the reservoir at a same distance in the vertical direction of the vehicle.

3. The internal combustion engine according to claim 1, wherein the oil separation devices are arranged in a cylinder head cover which is arranged above a cylinder head of the internal combustion engine in the vertical direction of the vehicle.

4. The internal combustion engine according to claim 3, wherein the return channels each have at least one second length section, through which the oil flows and which is arranged upstream of the respective length section in the flow direction of the oil flowing through the return channels, the second length section running within the cylinder head, wherein the second length section is delimited at least partially in its circumferential direction by the cylinder head.

5. The internal combustion engine according to claim 4, wherein the respective return channel is produced via drilling and/or via casting.

6. A motor vehicle having an internal combustion engine according to claim 5.

7. A method for operating an internal combustion engine according to claim 5.

* * * * *